US007259692B1

(12) United States Patent
Eichenberg

(10) Patent No.: US 7,259,692 B1
(45) Date of Patent: Aug. 21, 2007

(54) HYBRID POWER MANAGEMENT SYSTEM AND METHOD

(75) Inventor: Dennis J. Eichenberg, Parma Heights, OH (US)

(73) Assignee: The United States of America as represented by the Administrator of NASA, Washington, DC (US)

( * ) Notice: Subject to any disclaimer, the term of this patent is extended or adjusted under 35 U.S.C. 154(b) by 218 days.

(21) Appl. No.: 10/931,205

(22) Filed: Sep. 1, 2004

(51) Int. Cl.
*G08G 1/095* (2006.01)

(52) U.S. Cl. ..... 340/908; 304/43; 320/167; 340/815.45

(58) Field of Classification Search ..... 340/907, 340/908, 815.4, 815.45; 307/43, 157; 362/183, 362/800; 320/166, 167
See application file for complete search history.

(56) References Cited

U.S. PATENT DOCUMENTS 4,634,953 A * 1/1987 Shoji et al. ..... 368/205
5,345,154 A 9/1994 King
5,505,527 A 4/1996 Gray, Jr. et al.
5,589,743 A 12/1996 King
5,782,552 A * 7/1998 Green et al. ..... 362/183
5,898,282 A 4/1999 Drozdz
5,939,848 A 8/1999 Yano et al.
5,948,006 A * 9/1999 Mann ..... 607/61
6,044,922 A 4/2000 Field
6,068,078 A 5/2000 Rau et al.
6,135,913 A 10/2000 Lyon
6,138,784 A 10/2000 Oshima et al.
6,140,780 A 10/2000 Oshima et al.
6,217,398 B1 4/2001 Davis
6,230,496 B1 5/2001 Hofmann et al.
6,650,091 B1 * 11/2003 Shiue et al. ..... 320/166
6,680,548 B2 * 1/2004 Shiue et al. ..... 307/141
6,753,673 B2 * 6/2004 Shiue et al. ..... 320/166
6,778,093 B2 * 8/2004 Harwood ..... 340/815.45
2004/0036449 A1 * 2/2004 Bean et al. ..... 320/166
2005/0052165 A1 * 3/2005 Willner et al. ..... 323/266
2006/0194102 A1 * 8/2006 Keshishian et al. ..... 429/160

* cited by examiner

*Primary Examiner*—Thomas Mullen
(74) *Attorney, Agent, or Firm*—Arlene P. Neal; Kent N. Stone

(57) ABSTRACT

A system and method for hybrid power management. The system includes photovoltaic cells, ultracapacitors, and pulse generators. In one embodiment, the hybrid power management system is used to provide power for a highway safety flasher.

13 Claims, 4 Drawing Sheets

HYBRID POWER MANAGEMENT SYSTEM AND METHOD

ORIGIN OF THE INVENTION

The invention described herein was made by an employee of the United States Government and may be manufactured and used by or for the Government for Government purposes without the payment of any royalties thereon or therefor.

BACKGROUND OF THE INVENTION

1. Field of the Invention

The present invention relates to a system and method for hybrid power management. Hybrid power management systems incorporate various power devices, such as batteries, solar panels, gas engines, and electrical systems, into a single operational power system.

2. Description of the Related Art

Hybrid power systems integrate diverse power devices into a single working system. The power devices may include batteries, capacitors, and solar panels.

Some traditional hybrid power management systems use non-rechargeable batteries as a power source. Such power systems have a relatively low life cycle. Other power management systems may use rechargeable batteries, often nickel metal hydride batteries.

Even systems which include rechargeable batteries, however, have limited lifetimes. Rechargeable batteries can only be charged and discharged about 300 times. Therefore, batteries need to be replaced and discarded fairly frequently. This results in increased costs, both related to replacing the batteries and disposing of them in an environmentally safe manner. In addition, batteries do not perform very well at low temperatures and they may be difficult to replace in remote locations.

Thus, there is a need for a hybrid power management system that is reliable, easier to maintain, and cheaper to manage. Such a system can be provided by the present invention.

SUMMARY OF THE INVENTION

In one embodiment of the invention, a hybrid power management system is provided. The hybrid power management system includes a first power source, at least one ultracapacitor operably connected to the first power source, and a light source. The light source is connected to the at least one ultracapacitor.

The system may be configured to be used, for example, in a highway flashing safety device. The system may also include a voltage regulator that is connected to the at least one ultracapacitor. Additionally, the system may include a pulse generator that is connected both to the ultracapacitor and the first power source.

In another embodiment of the invention, a method for manufacturing a hybrid power management system is provided. The method includes the steps of installing a first power source in an enclosure and installing at least one ultracapacitor within the enclosure. The method also includes installing at least one light source within the enclosure, and installing a power switch in the enclosure.

The method further includes connecting the solar cell to the at least one ultracapacitor, connecting a zener diode in parallel with the at least one ultracapacitor, connecting the at least one ultracapacitor to a line side of the power switch, connecting a load side of the power switch to the at least one light source, and connecting the at least one light source to a negative side of the at least one ultracapacitor.

In a third embodiment of the invention, a method of operating a hybrid power management system is provided. The method includes the steps of receiving an electric current from at least one photovoltaic cell, supplying the electric current to the ultracapacitors, and providing the electric current from the ultracapacitors to a pulse generating module.

BRIEF DESCRIPTION OF THE DRAWINGS

For proper understanding of the invention, reference should be made to the accompanying drawings, wherein.

DETAILED DESCRIPTION OF THE PREFERRED EMBODIMENT(S)

The present invention, in one embodiment, combines photovoltaic cells and ultracapacitors to yield a hybrid power management system for providing power to an electric device.

Photovoltaic cells use sunlight to generate electricity. As such, photovoltaic cells may be used to power electrical devices by utilizing sunlight. A photovoltaic cell can include two or more thin layers of semi-conducting material, most commonly silicon. When the silicon is exposed to light, electrical charges are generated and this can be conducted away by a conductive material, such as metal contacts, as direct current (DC).

The present invention can also utilize ultracapacitor technology for energy storage. A capacitor is an electrical energy storage device which may include two or more conducting electrodes separated from each other by an insulating dielectric. An ultracapacitor is an electromechanical storage device, which has an extremely high volumetric capacitance energy due to high surface area electrodes, and very small electrode separation. Because chemical reactions do not occur in an ultracapacitor, very high charge and discharge currents are possible.

Ultracapacitors store electricity by physically separating positive and negative charges. It is an electromechanical double-layer system that stores energy in a polarized liquid layer at the interface between an ionically conducting electrolyte and a conducting electrode. Energy storage capacity increases by increasing the surface area of the interface. Therefore, ultracapacitors have the ability to provide large amounts of current in short bursts.

Overall, the hybrid power management system, and specifically the ultracapacitors, of the present invention provides power for surges when required and absorbs power from the system when required, allowing for smooth system load.

The use of ultracapacitors and photovoltaics provide distinct advantages over conventional power management systems, which generally employ batteries. Batteries can only be charged and discharged about 300 times, whereas ultracapacitors can be charged and discharged over 1 million times. The long life cycle of ultracapacitors improves the reliability of the system and also reduces costs over the life of the system. As a result, ultracapacitors do not need to be disposed of nearly as often as batteries, thereby providing an advantage to the environment. Additionally, batteries do not perform well at low temperatures, and therefore are not well-suited for certain outdoor applications, such as highway safety flashers. Ultracapacitors are reliable, consistent, and require little maintenance.

Figure 1:
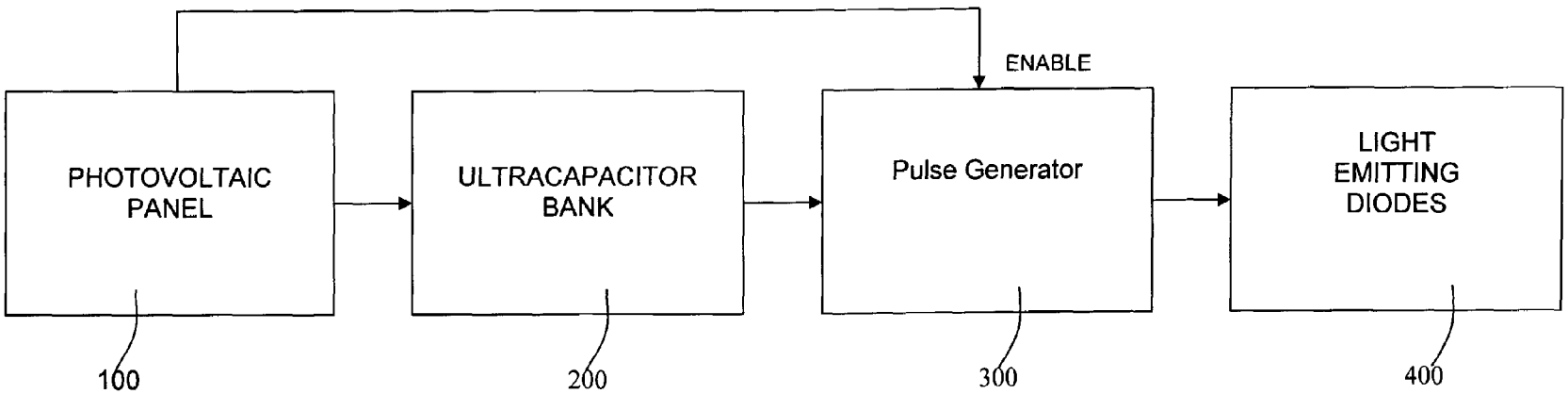
FIG. 1 illustrates a block diagram of an ultracapacitor powered safety flasher according to one embodiment.

FIG. 1 illustrates a block diagram of an electrical device utilizing the hybrid power management system according to one embodiment of the present invention. A panel of photovoltaic cells 100 is connected to a bank of ultracapacitors 200, which in turn is connected to a pulse generator 300. The pulse generator puts out a pulse of, for example, 100-milisecond duration once per second. The pulses are fed to the LED 400.

Figure 2:
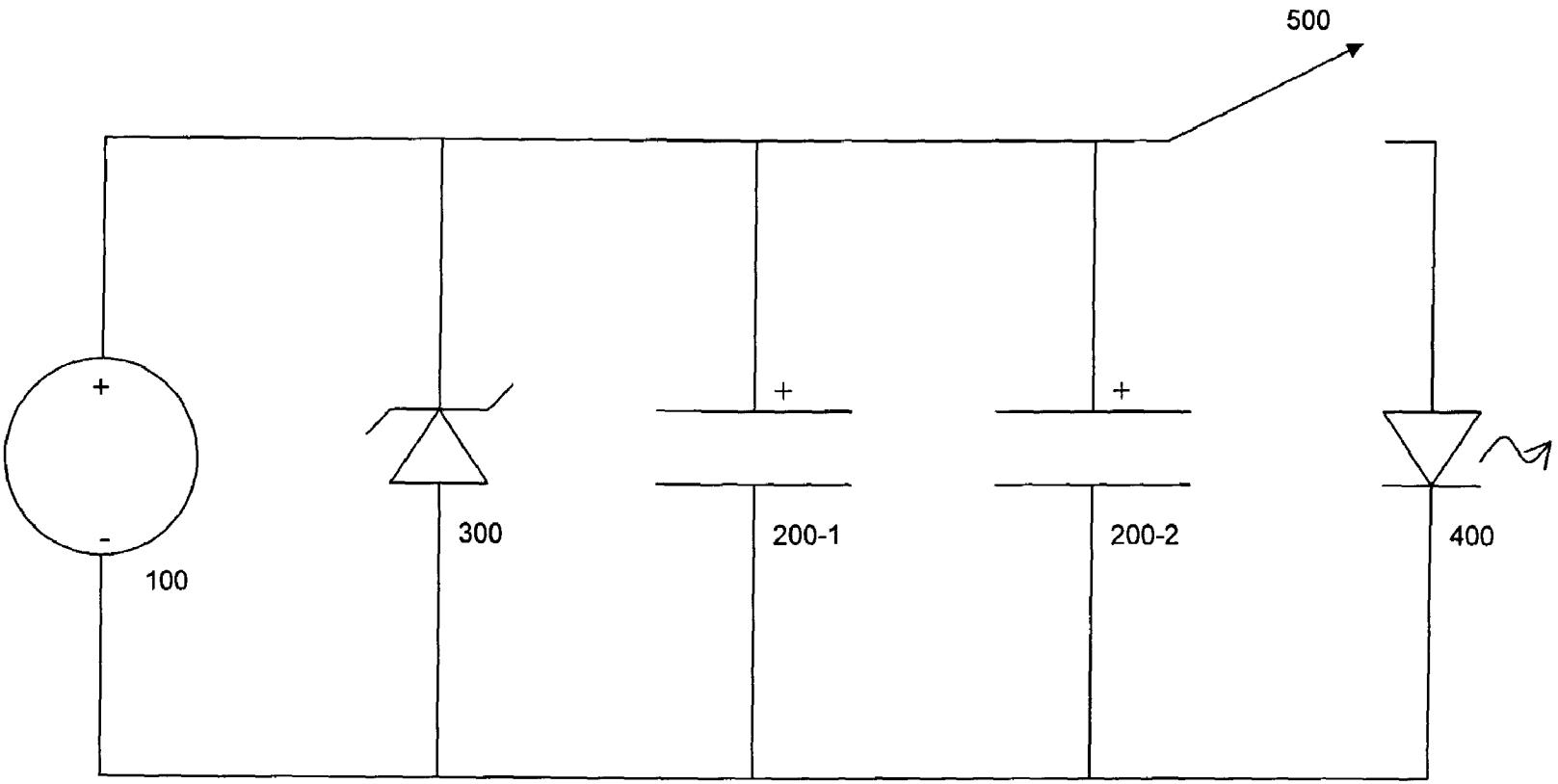
FIG. 2 illustrates a schematic diagram of an ultracapacitor powered safety flasher according to one embodiment.

FIG. 2 illustrates a schematic diagram, according to one embodiment, of an electrical circuit of the present invention. In this embodiment, a 3-volt 50-milliampere all-weather photovoltaic panel 100 is connected in parallel with two 100-farad ultracapacitors 200, and a pulse generator 300. The positive sides of the ultracapacitors 200 are connected to the line side of a power switch 500. The circuit results in power being generated for the LED 400.

In one embodiment of the present invention, the circuit discussed above and illustrated in FIG. 2 is included in a highway safety flasher. Safety flashers are used to mark actually or potentially hazardous areas, such as construction sites. The voltage developed by the photovoltaic panel serves to charge the ultracapacitors during the day and also serves as a signal to turn on the pulse generator at dusk and then turn it off at dawn. In this manner, the power stored by the ultracapacitors is used to power the safety flasher during the night-time hours.

The circuit illustrated in FIG. 2 may also be used for numerous other applications. For example, it may similarly be used in outdoor decorative lighting, automotive safety lights, marine safety lights, aircraft safety lights, or bicycle safety lights, flashlights, radios, and numerous other electronic devices.

Figure 3:
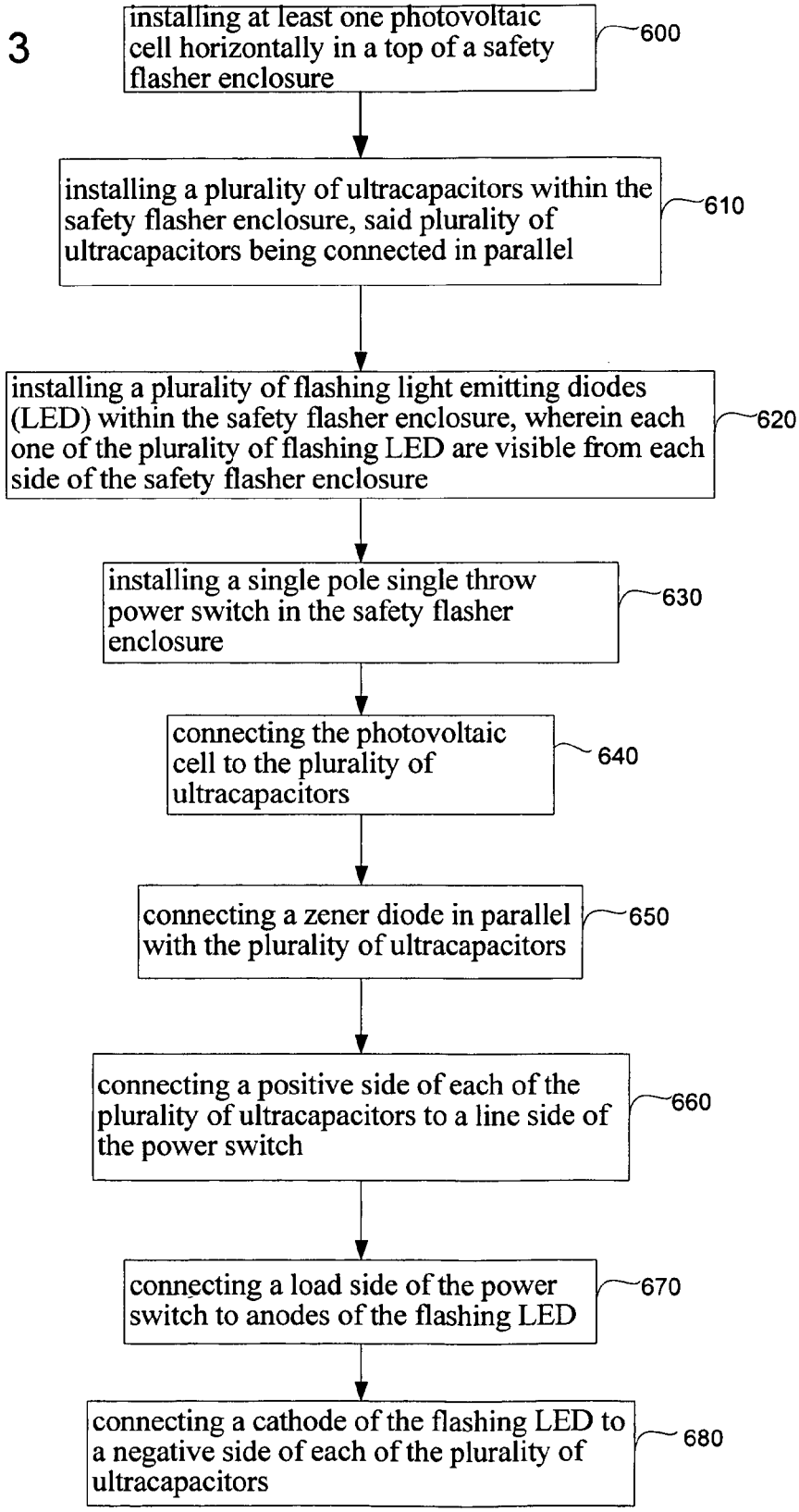
FIG. 3 illustrates a flow chart for the method of manufacturing an ultracapacitor powered safety flasher according to one embodiment.

FIG. 3 illustrates a flow chart of the method for manufacturing a safety flasher which employs an embodiment of the invention. The method includes the steps of installing at least one photovoltaic cell horizontally in a top of a safety flasher enclosure 600, and installing a plurality of ultracapacitors connected in parallel within the safety flasher enclosure 610. The method also includes installing a plurality of flashing light emitting diodes (LED) within the safety flasher enclosure such that each one of the flashing LEDs are visible from each side of the safety flasher enclosure 620, and installing a single pole single throw power switch in the safety flasher enclosure 630.

The method further includes connecting the solar cell to the plurality of ultracapacitors 640, connecting a zener diode in parallel with the plurality of ultracapacitors 650, and connecting a positive side of each of the plurality of ultracapacitors to a line side of the power switch 660. The method also includes connecting a load side of the power switch to anodes of the flashing LED's 670, and connecting a cathode of the flashing LEDs to a negative side of each of the plurality of ultracapacitors 680.

Figure 4:
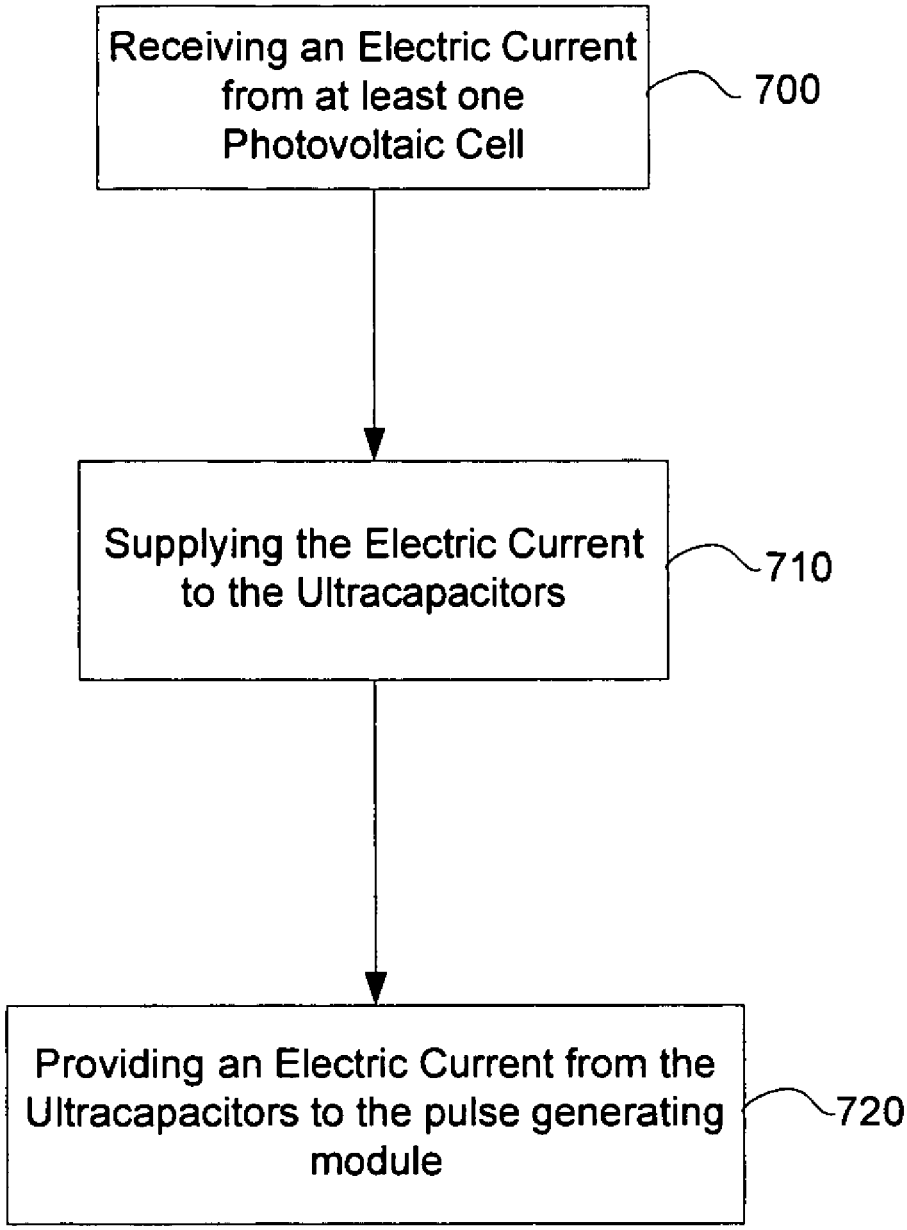
FIG. 4 illustrates a flow chart for the method of operating the hybrid power system according to one embodiment.

FIG. 4 illustrates a flow chart of the method of operating a hybrid power management system. The method includes the steps of receiving an electric current from at least one photovoltaic cell 700, supplying the electric current to at least one ultracapacitor 710, and providing the electric current from the at least one ultracapacitor to a pulse generating module 720.

One having ordinary skill in the art will readily understand that the invention as discussed above may be practiced with steps in a different order, and/or with hardware elements in configurations which are different than those which are disclosed. Therefore, although the invention has been described based upon these preferred embodiments, it would be apparent to those of skill in the art that certain modifications, variations, and alternative constructions would be apparent, while remaining within the spirit and scope of the invention. In order to determine the metes and bounds of the invention, therefore, reference should be made to the appended claims.

I claim:

1. A hybrid power management system, comprising:

a first power source;

at least one ultracapacitor, as a second power source, operably connected to the first power source;

at least one light source connected to the at least one ultracapacitor;

a power switch;

a solar cell connected to the at least one ultracapacitor; and a zener diode connected in parallel with the at least one ultracapacitor;

wherein a positive side of the at least one ultracapacitor is connected to a line side of the power switch, and a load side of the power switch is connected to the at least one light source.

2. The system of claim 1, wherein the first power source comprises at least one photovoltaic cell.

3. The system of claim 1, wherein the light source comprises at least one light emitting diode (LED) lamp.

4. The system of claim 1, wherein the system is configured to be used in a highway flashing safety device.

5. The system of claim 1, wherein the system is configured to be used in a flashlight.

6. The system of claim 1, wherein the system is configured to be used in an automotive safety light.

7. The system of claim 1, wherein the system is configured to be used in an aircraft safety light.

8. The system of claim 1, wherein the system is configured to be used in a radio.

9. The system of claim 1, wherein the system further comprises a pulse generator that is connected to the at least one ultracapacitor and the first power source.

10. A method for manufacturing a hybrid power management system, comprising the steps of:

installing a first power source for the system;

installing at least one ultracapacitor;

installing at least one light source;

installing a power switch;

connecting a solar cell to the at least one ultracapacitor;

connecting a zener diode in parallel with the at least one ultracapacitor;

connecting a positive side of the at least one ultracapacitor to a line side of the power switch;

connecting a load side of the power switch to the at least one light source;

connecting the at least one light source to the at least one ultracapacitor.

11. The method of claim 10, wherein said step of installing a first power source comprises installing at least one photovoltaic cell.

12. The method of claim 10, wherein said step of installing at least one light source comprises installing at least one light emitting diode (LED) lamp.

13. A hybrid power management system, comprising:

means for installing a first power source for the system;

means for installing at least one ultracapacitor;

means for installing at least one light source;

means for installing a power switch;

means for connecting a solar cell to the at least one ultracapacitor;

means for connecting a zener diode in parallel with the at least one ultracapacitor;

means for connecting a positive side of the at least one ultracapacitor to a line side of the power switch;

means for connecting a load side of the power switch to the at least one light source; and means for connecting the at least one light source to the at least one ultracapacitor.

* * * * *